United States Patent [19]

Staufer

[11] 3,949,988

[45] Apr. 13, 1976

[54] RACKET

[75] Inventor: Adolf Staufer, Ried im Innkreis, Austria

[73] Assignee: Fischer Gesellschaft m.b.H., Ried im Innkreis, Austria

[22] Filed: May 30, 1973

[21] Appl. No.: 365,065

[30] Foreign Application Priority Data

June 8, 1972 Austria ..... 4935/72

[52] U.S. Cl. ..... 273/73 F; 264/314; 280/11.13 L; 273/73 K

[51] Int. Cl.[2] ..... A63B 49/10

[58] Field of Search.... 273/67 R, 73 R, 73 C, 73 D, 273/73 F, 73 K, DIG. 7; 280/11.13 L; 264/152–156, 314–316

[56] References Cited

UNITED STATES PATENTS

| | | | |
|---|---|---|---|
| 2,728,702 | 12/1955 | Simon et al. | 273/73 F X |
| 2,878,020 | 3/1959 | Robinson | 273/73 F |
| 2,928,456 | 3/1960 | Potchen et al. | 273/73 F X |
| 3,493,240 | 2/1970 | Jenks | 273/73 F UX |
| 3,498,626 | 3/1970 | Sullivan | 280/11.13 L |
| 3,503,621 | 3/1970 | Schmidt et al. | 280/11.13 L |
| 3,574,104 | 4/1971 | Medler | 273/DIG. 7 |
| 3,614,116 | 10/1971 | Haldemann | 280/11.13 L |
| 3,628,802 | 12/1971 | Hashimoto | 280/11.13 L |
| 3,635,482 | 1/1972 | Holman | 280/11.13 L |
| 3,635,483 | 1/1972 | Barriball et al. | 280/11.13 L |
| 3,641,230 | 2/1972 | Jenks | 273/73 F UX |
| 3,690,658 | 9/1972 | Howe | 273/73 F X |
| 3,709,733 | 1/1973 | Mautner | 273/73 F X |
| 3,727,936 | 4/1973 | Klir et al. | 280/11.13 L |
| 3,755,037 | 8/1973 | Erwin et al. | 273/73 F X |
| 3,770,033 | 11/1973 | Gavillet et al. | 273/73 F X |
| 3,774,254 | 11/1973 | Meyer | 280/11.13 L |
| 3,787,051 | 1/1974 | Johns | 273/73 F |

FOREIGN PATENTS OR APPLICATIONS

| | | | |
|---|---|---|---|
| 241,018 | 2/1960 | Australia | 273/73 F |
| 2,033,630 | 11/1970 | France | 273/73 F |
| 2,005,952 | 10/1971 | Germany | 273/DIG. 7 |
| 9,123 | 12/1910 | United Kingdom | 273/73 K |
| 2,130,663 | 2/1972 | Germany | 273/73 F |
| 1,122,895 | 8/1968 | United Kingdom | 273/73 F |
| 241,018 | 2/1960 | Australia | 273/73 F |
| 1,942,082 | 3/1971 | Germany | 273/73 F |

*Primary Examiner*—Richard J. Apley
*Attorney, Agent, or Firm*—Imirie, Smiley & Linn

[57] ABSTRACT

The racket comprises a closed frame, a stringing which is stretched in this frame and forms a striking surface, and a handle for holding the racket. The handle merges at one end into the frame and forms an integral body therewith. Said body comprises an elongated core of an initially expansible material, and mainly longitudinally extending reinforcing fibers surrounding said core. The body is stiffened by structural straps at the outer surfaces of the handle and frame, which outer surfaces extend substantially at right angles to the striking surface, and on the inner surfaces of the frame, which inner surfaces extend substantially at right angles to the striking surface. The elongated core extends from the free end of the handle and through the latter into the frame and extends entirely around the frame.

3 Claims, 7 Drawing Figures

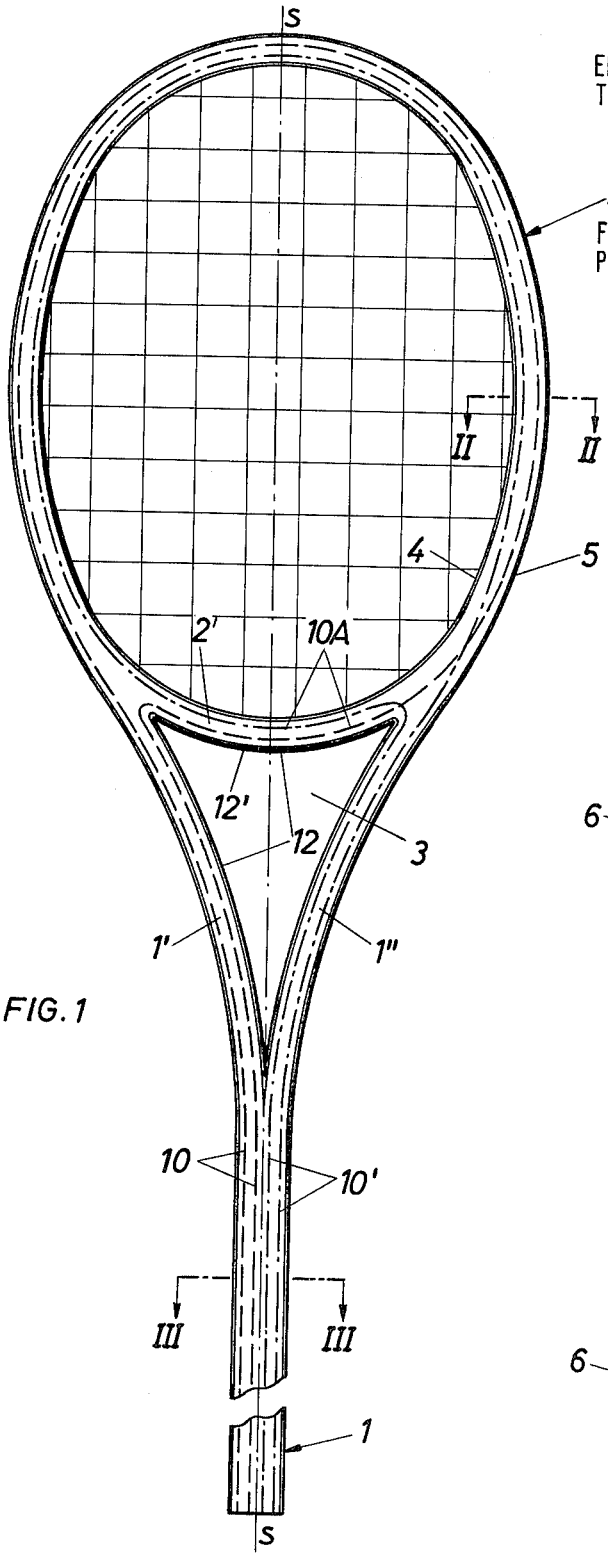
FIG. 1
FIG. 2
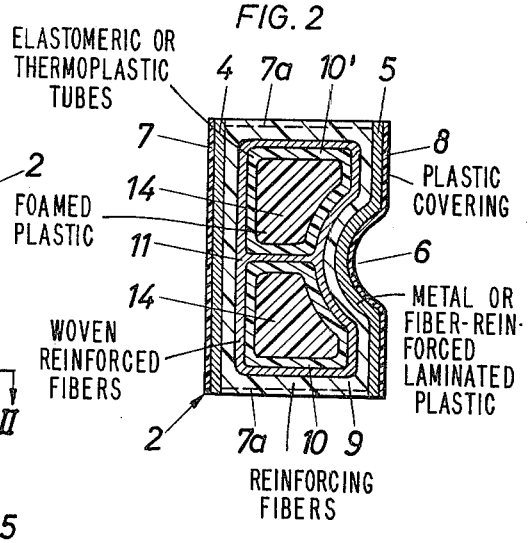
FIG. 3
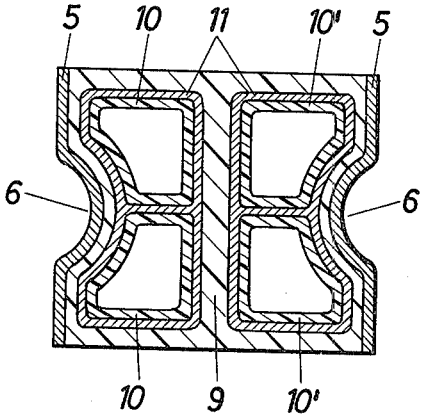
FIG. 4
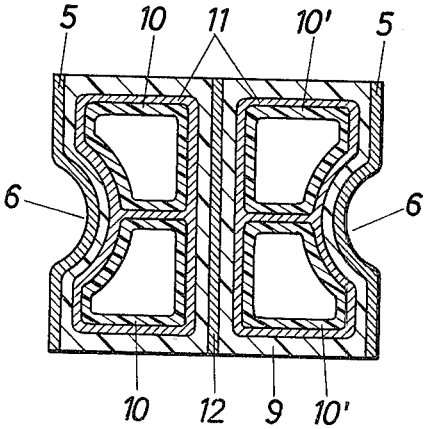

FIG. 6
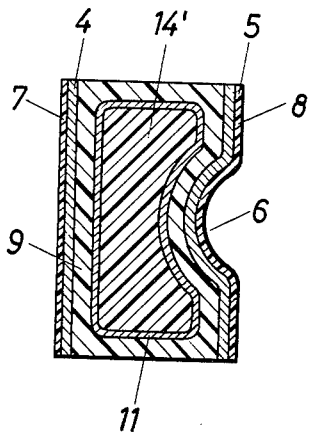
FIG. 5
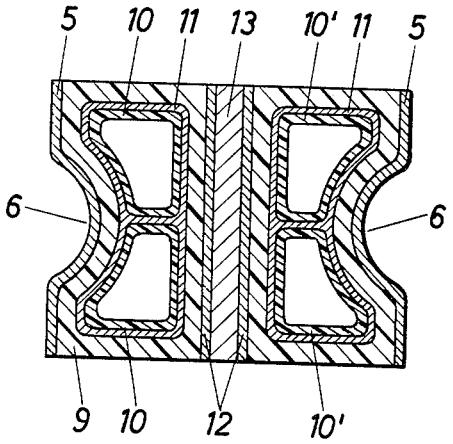
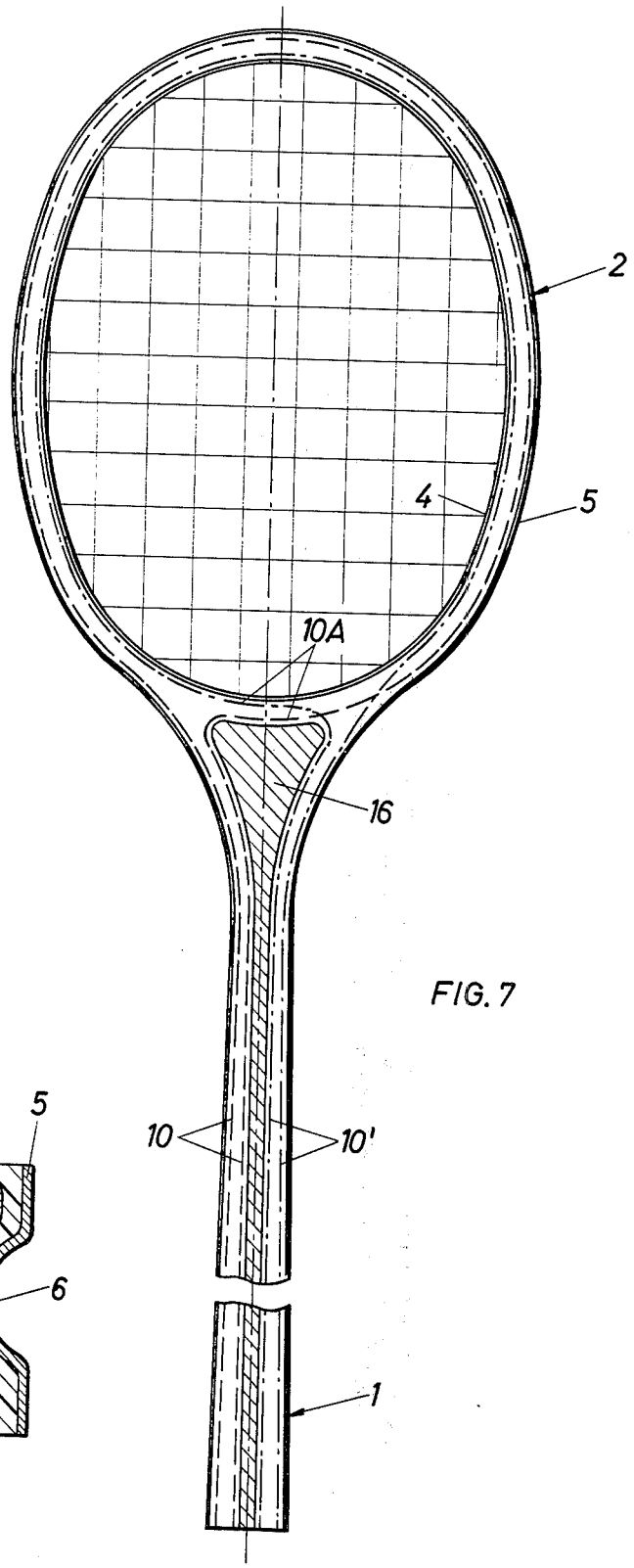
FIG. 7

RACKET

This invention relates to a racket, particularly a tennis racket, which comprises a frame and a handle extending from said frame.

BACKGROUND OF THE INVENTION

In ball games played with such rackets, a ball having a given mass is struck to impart a desired acceleration and direction to the ball. This is mainly due to an impact so that the transmission of momentum is of decisive significance. The forces required for this purpose are derived from the kinetic energy of the moving racket and from the muscle force of the player. The contribution of the kinetic energy depends on the mass or moment of inertia of the racket and on its angular velocity at the instant of the impact. At a given velocity, a high moment of inertia or a large mass will produce a large momentum and impart a high acceleration to the ball. On the other hand, a larger effort is required to accelerate a heavier racket. When the racket is too light, it can be more highly accelerated but a larger share of the momentum of the impact must be produced by the player. The deformation of the stringing, frame, and handle will depend on the stresses which are produced and on the stiffness of the material.

Different motions can be imparted to the ball in a game by a variation of the stiffnesses and the mass or the moment of inertia.

The previously known rackets consist of wood, metal or plastics material alone or in combination. Each type has a number of advantages and disadvantages which are specific thereto and which relate to the properties of the racket or to its manufacture. Almost all known types have the disadvantage that the properties cannot be sufficiently varied owing to considerations as regards the weight, the required strength properties, or the process of manufacturing the racket.

It has already been attempted to avoid these disadvantages by the production of a tennis racket which comprises eight rovings, which have been cured in a mold around an inflatable tube, by which the required pressure is applied.

In rackets having such a frame, the tube formed two legs extending in the handle and adjacent to the gusset at the transition from the handle into the oval frame diverged into the latter. Thus resulted in the disadvantage that no pressure was applied by the tube to that edge portion of the gusset which faced the stringing. The resulting racket frame was provided with a pregreg covering only in the lower one-third portion of the oval frame, next to the handle, as well as adjacent to the gusset and around the handle whereas the rovings were not covered in the remaining portion of the frame. As a result, the tube can hardly extend in the frame at the center of the cross section because it can yield in an uncontrolled manner inwardly and outwardly to the outer contour. This results in irregular cross-sections and in irregular mechanical properties of the frame.

Finally, laminated tennis rackets have been disclosed, which comprise a foam core which generally conforms to the contour of the tennis racket and at its surfaces which are parallel to the stringing is covered by metal or plastics materials skins having a yield strength above 3500 kilograms per square centimeter and a Young's modulus above 70,000 kilograms per square centimeter, and at its surfaces which are at right angles to the stringing is covered by straps having a compressive strength of about 315–1410 kilograms per square centimeter and a Young's modulus of about 70,000 kilograms per square centimeter and consisting preferably of polyethylene. These straps serve to strengthen the surfaces covered by them. This racket has the disadvantage that the stringing tends to slacken as it cuts into the foam core, which is protected only by a plastics material strap having a low stiffness. Besides, the metal plates must be cut from relatively large plates so that there is a substantial amount of waste.

SUMMARY OF THE INVENTION

The object of the present invention is to provide a composite racket in which the advantages which are specific to a relatively large number of materials can be utilized to provide desired mass and stiffness relations and in which sandwich and box structures are combined.

To accomplish this object, it is a feature of the invention to provide a racket, particularly a tennis racket, in which the frame and the handle extending from the frame consist of a core, which has been formed by expanding an elongated core element, and mainly longitudinally reinforcing fibers surrounding said core, and the core forms in the handle at least one elongated core element, which is forked as it extends into the frame, an elongated core portion connecting the diverging portions of the elongated core element is provided at the transition between the handle and the frame and disposed next to the inside edge of the frame, and the frame and handle body formed by the elongated core element and the reinforcing fibers is laterally stiffened by structural straps, which extend substantially at right angles to the striking surface.

According to another feature of the invention, the straps consist of sheet metal, such as age-hardened aluminum, or of fiber-reinforced plastics material, and may be flat or formed with embossed grooves. According to another feature of the invention, these straps have a modulus of elasticity above 200,000 kilograms per square centimeter.

According to a further feature of the invention, the reinforcing fibers consist of fibers of glass, carbon, boron, textile materials or metal and are in the form of rovings or woven fabrics which are embedded in thermoset synthetic resin, such as epoxy or polyester resin.

Also according to a feature of the invention, thermoplastic or elastomeric plastics materials are used in the form of strips or tubes.

The invention provides also a process of manufacturing such rackets, in which strips of metal or fiber-reinforced plastics material having a modulus of elasticity above 200,000 kilograms per square centimeter are placed in a mold which can be heated and cooled so that said strips extend on edge at right angles to the desired striking surface and conform to the outer and inner contours of the racket, the space between said strips is lined at the bottom and on the sides with reinforcing fibers, which extend mainly longitudinally and are impregnated with a thermosetting synthetic resin, at least one expansible elongated core element is embedded in the fibers to extend from the free end of the handle and entirely around thhe oval frame and back to the free end of the handle, the space which is disposed between the strips and above the elongated core element is filled with reinforcing fibers, which extend mainly longitudinally and are impregnated with thermosetting synthetic resin, the synthetic resin is cured under the action of heat and while the elongated core element is expanded, and the strips disposed on the outside are adhesively bonded at the same time.

Further details of the invention will be explained with reference to the drawing, which shows a plurality of embodiments of the racket according to the invention.

BRIEF DESCRIPTION OF THE INVENTION

FIG. 1 is a top plan view showing a racket according to the invention, which comprises a handle that is divided where it merges into the oval frame.

FIG. 2 is a sectional view taken on line II—II of FIG. 1.

FIG. 3 is a sectional view taken on line III—III in FIG. 1.

FIGS. 4 and 5 are sectional views which are similar to that of FIG. 3 and show modifications of the racket according to the invention.

FIG. 6 is a sectional view which is similar to that of FIG. 2 and shows another embodiment of the racket according to the invention.

FIG. 7 is a top plan view showing a racket according to the invention having a handle which is solid throughout.

DESCRIPTION OF THE PREFERRED EMBODIMENTS

The racket comprises a handle 1, which in the embodiment shown in FIG. 1 is forked where it merges into an oval frame 2. A substantially triangular opening 3 is defined by the two handle portions 1', 1'' and a bridge portion 2', which forms part of the frame.

The frame 2 has side faces which extend at right angles to the striking surface and which are formed by straps 4 and 5 made of metal strip or fiber-reinforced, laminated plastics materials having a modulus of elasticity which preferably exceeds 200,000 kilograms per square centimeter. The strap 5 extends also on the side faces of the handle 1 as far as to the outer end thereof. The outer strap 5 may be formed with suitable recesses, such as a central longitudinal groove 6, for receiving the stringing. The surfaces of both straps 4, 5 may be covered by layers 7 and 8 of plastics material having a modulus of elasticity below 80,000 kilograms per square centimeter, such as ABS or SUP. Similar layers may be provided in this and all other embodiments on those surfaces of the frame 2 and possibly of the handle 1 which extend parallel to the striking surface. This is indicated in dotted lines at *7a* in FIG. 2. Rovings 9 of reinforcing fibers, such as fibers of glass, graphite, boron, metal, or textiles, are disposed between the straps 4, 5. These fibers are embedded in a thermoset synthetic resin, such as epoxy resin or polyester resin, and extend preferably longitudinally and form a boxlike configuration. The thickness of the rovings layers may be varied to provide for the desired stiffness and strength values. Specifically, the walls which adjoin the straps 4, 5 may be thinner than those which are at right angles thereto. The resin-impregnated rovings 9 are located by means of at least one and preferably two elongated core elements 10, 10' in the form of inflatable tubes or of elements which can be expanded under pressure and/or at elevated temperatures and consist of elastomeric or thermoplastic plastics material. These elongated core elements are pressurized from the inside when the resin is cured. As the tubes expand, they force the rovings against the straps 4, 5 and the walls of the closed mold so that an exactly boxlike configuration is imparted to the cross-section of the frame. To increase the torsional stiffness and to improve the transverse bond, the tubes may be surrounded by a woven layer 11 of reinforcing fibers.

As is apparent from FIG. 2, the two tubes 10, 10' are arranged one over the other. To facilitate the understanding of the following explanation of the arrangement of the two tubes in the frame 2 and the handle 1, the tubes are indicated in FIG. 1 by dotted and dash-dot lines disposed one beside the other. Each of these lines represents one tube. It is apparent that the tubes 10 and 10' extend from the free end of the handle 1 along the same, around the oval frame 2 and along the bridge portion 2' back to the same side of the axis of symmetry *s—s* of the handle 1. As a result, the tubes 10 and 10' cross at the connecting portion 2' so that this part of the frame can also be pressurized from the inside.

If only one tube is provided in the frame, the connecting portion 2' must bbe pressurized by a tube portion welded to the single tube or by an additional inflatable tube.

The resulting core or tube section provided according to the invention is designated 10A.

The rovings 9 may extend entirely or in part like the tubes 10, 10' or other core elements so that stress concentrations due to notches at the transition from the handle to the frame are minimized. The fact that the bridge portion 2' is smaller in cross-section in accordance with the ratio of crossing and continuous rovings is compensated by the provision of additional reinforcing fibers.

The strap 4 disposed in FIG. 2 on the inside of the frame is arranged to conform to the striking surface. The outer strip extends along the outer contour of the racket. A correspondingly shaped, adequate strip 12 is inserted at the inside of the forked portion of the handle and forms one wall 12' of the bridge portion 2' in FIG. 1. As is shown in connection with the modifications illustrated in FIGS. 4 and 5, this strip 12 may extend in one or two thicknesses in the central portion of the handle as far as to the end thereof. To increase the width and stiffness of the thus divided handle, inserts 13 (FIG. 5) of plastics material, wood or metal may be inserted between the halves of such handle. Several alternatives are thus available as far as the cross-section of the handle is concerned. In the embodiments shown in FIGS. 4 and 5, the strips 12 increase the stiffness of the handle at right angles to the striking surface.

Holes for holding the stringing are drilled into the frame. The stringing may be additionally protected by inserted bushings of metal or plastics material.

The internal pressure is preferably produced by compressed air. Alternatively, a mixture which can be reacted to form a foamed plastics material, such as polyurethane, can be injected into the tubes and the mixture can then be foamed to produce the internal pressure. This is indicated in FIG. 2 by the filling 14. Instead of the tubes 10, 10', a flexible elongated core element may be used which consists of a plastics material that begins to foam in response to a predetermined rise of the temperature above the ambient temperature to produce the required pressure. The resulting frame cross-section is shown in FIG. 6. The foamed plastics material 14' is formed in the interior of the box which has been formed by the fiber roving 9 and the optional woven fibers 11. As the elements are assembled, the plastics material 14' is inserted in the form of an elongated core element which is unfoamed or only partly foamed and which foams to the final volume when the mold has been closed and the temperature has been increased. In this case there is no need for two elongated core elements in the cross-section because the elongated core element of plastics material in the bridge portion 2' of FIG. 1 can be additionally inserted without difficulty.

The process which has been described is not restricted to the embodiment shown in FIG. 1. It is also applicable to rackets in which the handle is solid throughout rather than having a forked portion which defines a triangular opening. Instead of the strap 12 in FIG. 1, a correspondingly shaped member 16 of metal, wood or preferably foamed plastics material may be inserted (FIG. 7).

The properties of the racket according to the invention may be widely varied by the use of different materials and different dimensions. For instance, if the straps 4, 5 and, if desired, 12, consist of an age-hardened aluminum alloy, and the rovings 9 consist of glass fibers, a racket having a given stiffness will be slender when viewed at right angles to the striking surfce and will present only a slight drag where rovings are used which have a high modulus of elasticity above 700,000 kilograms per square centimeter, such as rovings of fibers of carbon, boron or metal, and straps 4, 5 and 12 are used which consist of laminated plastics materials reinforced by glass fibers, the profile will be wider and lower. The mass may also be varied by the use of different combinations of materials. In the embodiment pressurized with compressed air, the cavities in the cross-section may be filled with foamable materials of different densities to vary the center of gravity and with it the moment of inertia.

What is claimed is:

1. A racket comprising an elongated member closed upon itself to form a curvilinear head frame having a bridge portion, a stringing which is stretched in this frame and forms a striking surface, and an elongated handle for holding the racket, said handle havng a pair of forked arms at one end merging into the frame at said bridge portion and forming an integral body therewith, which body comprises an elongated core constructed of an expansible material and means surrounding said core for longitudinally reinforcing the same, said reinforcing means comprising a layer of resin impregnated woven reinforcing fibers surrounding said expansible core and a layer of resin impregnated longitudinally extending reinforcing fibers surrounding said woven fiber layer, said body being stiffened by aluminum structural straps attached to and conforming only with inner and outer surfaces of said reinforcing means, which surfaces extend substantially at right angles to the plane of the striking surface, said straps having a modulus of elasticity greater than 200,000 kilograms per square centimeter, said elongated core comprising a first core element extending from the free end of the handle on one side of the racket axis through one of said forked arms, around said head frame, across said bridge, and back through said one arm into said handle, and a second core element extending from the free end of the handle on the other side of the racket axis through the other of said forked arms, around said head frame, across said bridge, and back through said other arm into said handle, said core elements disposed one over the other throughout said racket on respective perpendicular sides of the string plane, said core elements containing a foamable plastic material which expands and exerts pressure on said reinforcing means after foaming.

2. A racket as set forth in claim 1, in which additional layers consisting of plastic material having a low modulus of elasticity below 80,000 kilograms per square centimeter are provided on the outer surfaces of the straps.

3. A racket as set forth in claim 1, in which additional layers consisting of a plastic material having a low modulus of elasticity below 80,000 kilograms per square centimeter are provided on those surfaces of the frame and handle which extend parallel to the striking surface.

* * * * *